US009039433B2

(12) United States Patent
Barthelmes et al.

(10) Patent No.: US 9,039,433 B2
(45) Date of Patent: May 26, 2015

(54) ELECTRICAL CONNECTOR ASSEMBLY WITH HIGH FLOAT BULLET ADAPTER

(71) Applicant: Amphenol Corporation, Wallingford, CT (US)

(72) Inventors: Owen Robert Barthelmes, Putnan Valley, NY (US); Michael Andrew Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 134 days.

(21) Appl. No.: 13/737,375

(22) Filed: Jan. 9, 2013

(65) Prior Publication Data

US 2014/0193995 A1 Jul. 10, 2014

(51) Int. Cl.

| | |
|---|---|
| ***H01R 13/64*** | (2006.01) |
| ***H01R 13/629*** | (2006.01) |
| ***H01R 12/91*** | (2011.01) |
| ***H01R 24/54*** | (2011.01) |
| *H01R 103/00* | (2006.01) |
| *H01R 12/73* | (2011.01) |

(52) U.S. Cl.

CPC ..... *H01R 13/629* (2013.01); *H01R 2103/00* (2013.01); *H01R 12/737* (2013.01); *H01R 12/91* (2013.01); *H01R 24/542* (2013.01)

(58) Field of Classification Search

CPC ..... H01R 13/6315
USPC ..... 439/63, 607.05, 607.13, 246–248, 252, 439/382, 383, 385, 2
See application file for complete search history.

(56) References Cited

U.S. PATENT DOCUMENTS

| | | | | |
|---|---|---|---|---|
| 2,603,681 | A * | 7/1952 | Salisbury | 439/58 |
| 2,999,998 | A * | 9/1961 | Cole | 439/252 |
| 3,713,075 | A * | 1/1973 | Clark | 439/246 |
| 4,227,765 | A * | 10/1980 | Neumann et al. | 439/248 |
| 4,466,048 | A | 8/1984 | Schwab | |
| 4,541,032 | A | 9/1985 | Schwab | |
| 4,674,809 | A | 6/1987 | Hollyday et al. | |
| 4,726,787 | A | 2/1988 | Stine | |
| 4,728,301 | A * | 3/1988 | Hemmer et al. | 439/578 |
| 4,789,351 | A * | 12/1988 | Fisher et al. | 439/248 |
| 4,846,731 | A * | 7/1989 | Alwine | 439/651 |
| 4,857,014 | A * | 8/1989 | Alf et al. | 439/578 |
| 4,925,403 | A * | 5/1990 | Zorzy | 439/578 |
| 5,062,808 | A * | 11/1991 | Hosler, Sr. | 439/580 |
| 5,137,462 | A * | 8/1992 | Casey et al. | 439/74 |

(Continued)

FOREIGN PATENT DOCUMENTS

DE 202012000487 U1 2/2012

*Primary Examiner* — Ross Gushi
(74) *Attorney, Agent, or Firm* — Blank Rome LLP

(57) ABSTRACT

A high float connector assembly that comprises a first connector that has at least a first contact, a second connector that is configured to mate to the first connector, wherein the second connector has at least a second contact, a high float bullet adapter that is disposed between the first and second connectors, wherein the high float bullet adapter includes a housing that has at least one hole, and at least one high float bullet subassembly is received in the hole of the housing. The high float bullet subassembly has an inner contact, an insulator that supports the inner contact, and an outer ground body that holds the inner contact and the insulator. The insulator has an end with a lead-in geometry. The inner contact engages the first and second contacts of the first and second connectors, respectfully, wherein the high float bullet subassembly provides float between the connectors.

25 Claims, 9 Drawing Sheets

(56) References Cited

U.S. PATENT DOCUMENTS

| | | | | |
|---|---|---|---|---|
| 5,217,391 | A * | 6/1993 | Fisher, Jr. | 439/578 |
| 5,257,161 | A * | 10/1993 | Ocerin | 361/605 |
| 5,329,262 | A * | 7/1994 | Fisher, Jr. | 333/33 |
| 5,548,088 | A | 8/1996 | Gray et al. | |
| 5,647,749 | A * | 7/1997 | Atoh et al. | 439/79 |
| 5,700,160 | A | 12/1997 | Lee | |
| 5,879,177 | A * | 3/1999 | Honma | 439/246 |
| 5,980,290 | A * | 11/1999 | Meynier et al. | 439/246 |
| 6,059,577 | A * | 5/2000 | Eriksson | 439/8 |
| 6,079,986 | A | 6/2000 | Beshears | |
| 6,166,615 | A | 12/2000 | Winslow et al. | |
| 6,174,206 | B1 | 1/2001 | Yentile et al. | |
| 6,224,421 | B1 * | 5/2001 | Maturo, Jr. | 439/581 |
| 6,497,579 | B1 * | 12/2002 | Garbini | 439/63 |
| 6,663,434 | B1 | 12/2003 | Wu | |
| 6,695,622 | B2 * | 2/2004 | Korsunsky et al. | 439/65 |
| 6,773,285 | B2 * | 8/2004 | Bernat et al. | 439/246 |
| 6,773,286 | B1 | 8/2004 | Wu | |
| 6,814,630 | B1 | 11/2004 | Tomasino | |
| 6,827,608 | B2 * | 12/2004 | Hall et al. | 439/578 |
| 6,835,079 | B2 * | 12/2004 | Gentry et al. | 439/188 |
| 6,908,325 | B2 * | 6/2005 | Bernat et al. | 439/246 |
| 6,976,862 | B1 * | 12/2005 | Ormazabal Ocerin | 439/246 |
| 7,112,078 | B2 * | 9/2006 | Czikora | 439/248 |
| 7,210,941 | B2 * | 5/2007 | Rosenberger | 439/63 |
| 7,229,303 | B2 | 6/2007 | Vermoesen et al. | |
| 7,306,484 | B1 | 12/2007 | Mahoney et al. | |
| 7,442,080 | B1 * | 10/2008 | Tsen | 439/578 |
| 7,445,458 | B1 * | 11/2008 | Yamane | 439/63 |
| 7,445,467 | B1 * | 11/2008 | Matsuo | 439/74 |
| 7,478,475 | B2 * | 1/2009 | Hall | 29/869 |
| 7,563,133 | B2 * | 7/2009 | Stein | 439/578 |
| 7,645,151 | B2 | 1/2010 | Moll et al. | |
| 7,717,716 | B2 * | 5/2010 | Dahms | 439/63 |
| 7,731,528 | B2 | 6/2010 | Feldman et al. | |
| 7,762,854 | B1 | 7/2010 | Peng | |
| 7,896,655 | B1 * | 3/2011 | Blasick et al. | 439/63 |
| 8,323,058 | B2 * | 12/2012 | Flaherty et al. | 439/680 |
| 8,360,789 | B2 * | 1/2013 | Yin et al. | 439/66 |
| 8,568,163 | B2 * | 10/2013 | Burris et al. | 439/578 |
| 8,573,983 | B2 * | 11/2013 | Zieder | 439/8 |
| 8,597,050 | B2 * | 12/2013 | Flaherty et al. | 439/578 |
| 8,734,167 | B2 * | 5/2014 | Aimoto | 439/74 |
| 8,801,459 | B2 * | 8/2014 | Mrowka | 439/578 |
| 2002/0061670 | A1 * | 5/2002 | Havener et al. | 439/246 |
| 2002/0111057 | A1 * | 8/2002 | Bernat et al. | 439/246 |
| 2002/0142625 | A1 * | 10/2002 | Berghorn et al. | 439/63 |
| 2004/0014334 | A1 * | 1/2004 | Lu | 439/63 |
| 2004/0038586 | A1 * | 2/2004 | Hall et al. | 439/578 |
| 2004/0229490 | A1 * | 11/2004 | Bernat et al. | 439/246 |
| 2005/0037650 | A1 * | 2/2005 | Hsu et al. | 439/246 |
| 2006/0024985 | A1 * | 2/2006 | Nagata et al. | 439/63 |
| 2006/0194465 | A1 * | 8/2006 | Czikora | 439/248 |
| 2006/0258209 | A1 * | 11/2006 | Hall | 439/578 |
| 2007/0026698 | A1 * | 2/2007 | Rosenberger | 439/63 |
| 2009/0149086 | A1 * | 6/2009 | Dahms | 439/835 |
| 2009/0186495 | A1 * | 7/2009 | Taylor | 439/66 |
| 2009/0215295 | A1 * | 8/2009 | Tseng | 439/247 |
| 2009/0239422 | A1 * | 9/2009 | Fukazawa et al. | 439/660 |
| 2009/0264008 | A1 * | 10/2009 | Matsuda et al. | 439/460 |
| 2010/0007441 | A1 * | 1/2010 | Yagisawa et al. | 333/185 |
| 2010/0075536 | A1 * | 3/2010 | Kubo | 439/620.21 |
| 2011/0151714 | A1 * | 6/2011 | Flaherty et al. | 439/578 |
| 2011/0237123 | A1 * | 9/2011 | Burris et al. | 439/578 |
| 2011/0237124 | A1 * | 9/2011 | Flaherty et al. | 439/578 |
| 2012/0295478 | A1 * | 11/2012 | Mrowka | 439/578 |
| 2014/0193995 | A1 * | 7/2014 | Barthelmes et al. | 439/374 |
| 2014/0206218 | A1 * | 7/2014 | Liu et al. | 439/247 |

* cited by examiner

FIG. 9A
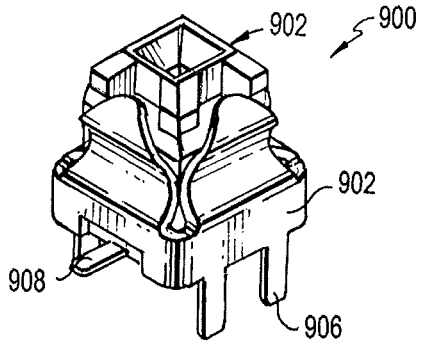
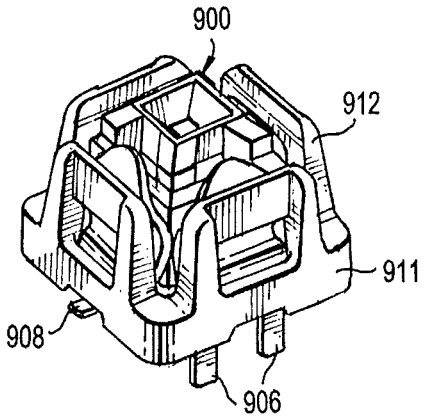
FIG. 9B

ELECTRICAL CONNECTOR ASSEMBLY WITH HIGH FLOAT BULLET ADAPTER

FIELD OF THE INVENTION

The present invention relates to an electrical connector, such as a radio frequency connector. In particular, the present invention relates to a high-density electrical connector assembly with a high float bullet option for increased tolerance.

BACKGROUND OF THE INVENTION

An RF connector is an electrical connector designed to work at radio frequencies in the multi-megahertz range. Typically, RF connectors are used in a variety of applications such as wireless telecommunications applications, including WiFi, PCS, radio, computer networks, test instruments, and antenna devices. In one application, a plurality of individual connectors are ganged together into a single, larger connector housing for electrically and physically connecting two or more printed circuit boards together.

One example of an RF connector interface is the sub-miniature push-on (SMP) interface. SMP is commonly used in miniaturized high frequency coaxial modules and is offered in both push-on and snap-on mating styles and is often used for PC board-to-board interconnects. For these applications, the conventional SMP interface utilizes a male connector on each of the PC boards and a female-to-female adapter mounted in between to complete the connection. The female adapter is often called a "bullet" and is used to provide a flexible link between the male connectors. This flexible link typically allows 0.020 inches of radial float and 0.010 inches of axial float, where radial float and axial float refer to the ability to tolerate axial and radial misalignment. For example, radial misalignment occurs when the male connector does not line up properly with the female connector (e.g., off-center). When connecting together two PCBs together using a multiple connectors on each PCB (e.g., a grid pattern), radial misalignment can be the result of manufacturing differences in the spacing between the individual connectors on a first PCB relative to the spacing between each of the individual connectors on the second PCB due to manufacturing variance of the PCB or the electronic package where it is mounted. For example, radial misalignment can occur when the tip of a male connector is centered over the center of the receptacle, but the base of the male connector (mounted to the PCB) is off-center. Axial misalignment occurs when a connector mated distance from the corresponding receptacle can vary due to positional tolerance of the PCB and the electronic package. Additionally, often one male connector will be specified as a snap on interface and the other as a push on to ensure that the bullet adapter remains fixed in the same male connector if the PC boards are separated. Bullets are also typically available in multiple lengths to allow for different board spacing.

Another aspect of conventional connectors is that they may support "blind mate" gathering. Generally, a blind mate connector is a connector in which, during the mating process, a human operator can neither see nor feel it to ensure that the connector is correctly aligned. "Blind-mate" refers to a feature that allows an operator to join the connectors without visually seeing the connector interfaces mate. Blind mate connectors typically have self-aligning features which allow for a small misalignment when mating.

Conventional multi-position RF connectors include a conductive inner portion that is surrounded by an insulating outer portion (or "insulator"), where at the mating interface, the insulator is recessed relative to the conductive outer portion.

Conventional multi-port RF connectors also typically include a shared conductive outer portion in the form of a common metal body between individual connectors, where the metal body is formed using a manufacturing method such as zinc die casting. Conventional RF connectors with a mechanical float provision typically come in plug-to-plug configurations, meaning that the connector is adapted to male connectors on each end for connecting with corresponding female receptacles.

One problem associated with conventional multi-port RF connectors is that the density of individual connectors is limited by the shape and design of the insulator and conductive outer portion. Specifically, because conventional insulators are recessed relative to the conductive outer portion, the insulator must be at least as large as the conductive outer portion plus additional tolerances. As RF connector applications have begun to require a greater number of individual connections between components, RF connectors using conventional recessed designs have necessarily increased in size to accommodate this. Larger connectors require more physical space in order to provide the necessary contacts, which make the connectors less applicable to high density systems requiring smaller connectors and more expensive to produce.

Another problem associated with conventional RF connectors is that such connectors typically do not have the flexibility to customize the degree of axial or radial float. As described above, float is the tolerance of physical movement of the connectors once mated in a fixed position. Some conventional connectors are configured for high-float applications. For example, when connecting two PCBs, it may be desirable to use a high axial float connector in order to accommodate variations in the distances between various components on the PCBs that are being connected. Alternately, it may be desirable to use a low- or no-float connector when connecting PCBs where a secure fit is achievable and there is less likely to be movement (i.e., stresses) between the PCBs or if the connector contains the aligning features that control position such as close tolerance guide pins. Using conventional connectors, the amount of float provided by connectors is fixed and cannot be applied to either high- or low-float applications without using a different connector.

Accordingly, there is a need for a modular and scalable RF connector for high-density gang mate solutions for both high-float and low-float applications. There is also a need for a high density connector that has a high mechanical float while maintaining high isolation and low-loss electrical performance.

SUMMARY OF THE INVENTION

Accordingly, the present invention provides a high float bullet adapter, that comprises an inner contact, an insulator that supports the inner contact, and an outer ground body that holds the inner contact and the insulator, wherein an end of the insulator extends beyond the inner contact and the outer ground body, and the end of the insulator having a lead-in geometry.

The present invention may also provide a high float connector assembly, that comprises a first connector that has at least a first contact, a second connector that is configured to mate to the first connector, the second connector having at least a second contact, a high float bullet adapter disposed between the first and second connectors, the high float bullet adapter includes a housing that has at least one hole; and at least one high float bullet subassembly that is received in the hole of the housing of the high float bullet adapter, at least one high float bullet subassembly that has an inner contact, an insulator that supports the inner contact, and an outer ground body that holds the inner contact and the insulator, the insulator has an end with a lead-in geometry, the inner contact that engages the first and second contacts of the first and second connectors, respectfully, wherein the at least one high float bullet subassembly provides float between the first and second connectors.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

FIGS. 9A is a perspective view of yet another alternative high float bullet sub-assembly, according to an exemplary embodiment of the present invention;

FIG. 9B is a perspective view of the high float bullet sub-assembly that includes a housing to help center the bullet and provide additional retention;

DETAILED DESCRIPTION OF THE PREFERRED EMBODIMENTS

Figure 1:
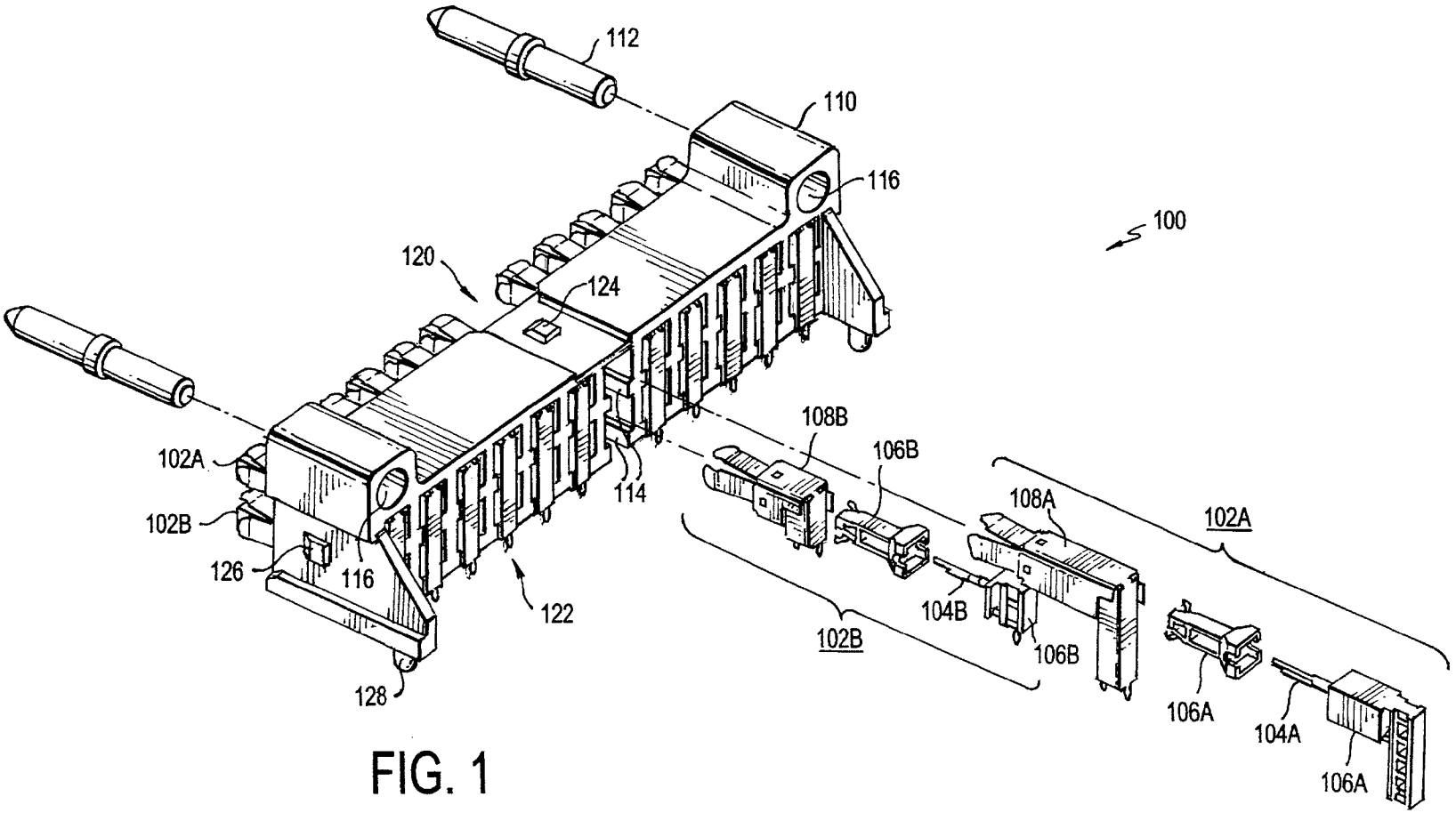
FIG. 1 is an exploded perspective view of a right angle PCB plug assembly according to an exemplary embodiment of the present invention.

Several preferred embodiments of the invention are described for illustrative purposes, it being understood that the invention may be embodied in other forms not specifically shown in the drawings.

The subject matter described herein relates an electrical connector, such as a radio frequency (RF) connector, that is applicable to high density gang-mate printed circuit board PCB-to-PCB solutions in either high float or low float configurations, where float is the tolerance of physical movement or misalignment compensation of the connectors once mated in a fixed position. More specifically, the present invention provides a connector that may have a protruding insulator from a plug interface thereof that has a narrowing shape, such as a pyramid or "dart" shaped lead-in geometry at its tip. Additionally, the present invention includes a bi-gender bullet that has a plug interface on one end and a receptacle interface on the opposite end for providing modular add-on float capability between connectors.

Regarding the first aspect of the present invention, a dart shaped insulating material protrudes from an outer metal housing and protects a recessed, inner contact to facilitate gathering. As used herein, gathering is the process of aligning a plug and a receptacle during the mating process. For example, gathering may include inserting the tip of the plug into a cone (or other) shaped receptacle of the receptacle. Selection of specific shapes of both the tip of the plug and the receptacle aids in aligning the tip to the center of the receptacle through physical contact with the cone and redirection of the insertion forces to a desired position. The present invention is an improvement over the prior art at least in that, by using the protruding insulator for gathering, the geometry of the plug interface required to gather shrinks, and thus a smaller lead-in geometry is possible on the mating receptacle interface.

Another advantage of the present invention is that the inverted pyramid gathering feature on the receptacle insulator aids with blind mate gathering (plugging the connector into a board without human intervention) of the receptacle center contact pin. Yet another advantage of the present invention is that the insulator on the plug provides closed entry protection for female contact on the plug. In other words, it may prevent unwanted contact between the inner contact portion and other portions of the plug (e.g., the outer casing) or portions of the mating receptacle interface.

Regarding the second aspect, the present invention is an improvement over the prior art at least in that the bi-gender bullet allows for increasing the amount of mechanical float between a male and female connector assembly simply by adding the bi-gender bullet between the connectors. Low-float configurations are made by directly mating a male and a female connector without using a bullet therebetween. Thus, the bi-gender bullet of the present invention allows for selecting between low-float and high-float configurations without requiring a change in the gender of either of the connectors. This modular design allows for simpler, cheaper, and more flexible connector products that may use either high float or low float configurations. In contrast, most conventional designs require that the mating connectors have the same interface for high-float configurations.

A bullet according to the present invention may be retained on the standard plug interface with a plastic carrier housing that snaps onto the plug housing. The snap-on feature on the plug housing converts any non-bulleted solution to one having one or more bullets added for additional radial float between connectors.

Turning now to FIG. 1, FIG. 1 depicts an exploded view of an exemplary right-angle PCB plug assembly 100 according to the present invention. This is referred to as a right angle solution because the connector pins located within the plug assembly 100 are bent at ninety degree angles to allow for connecting two PCBs located coplanar or at a right angle to one another when mated with an appropriate corresponding receptacle assembly. It is appreciated that connectors can be either a plug or a receptacle (i.e., male or female) and either a right angle or straight configuration, or any combination thereof. For simplicity of discussion, the subject matter described herein will illustrate and describe a subset of the total number of these possible permutations. However, this is not intended to limit the present invention to any particular combination thereof.

As used herein, the term "contact sub-assembly" refers to an individual connector that includes at least a contact portion, but may also include an insulator portion and a ground body portion, for physically and electrically interfacing with another connector or a PCB. As shown in FIG. 1 this includes a contact sub-assembly 102A (tall right angle configuration) and 102B (short right angle configuration), for example. The term "plug assembly" or "plug" refers to a physical grouping of contact sub-assemblies within a housing having a male interface for connecting to a female interface of a receptacle assembly. The term "receptacle assembly" or "receptacle" refers to a grouping of female interfaces within a housing for receiving a male interface of a plug assembly. The term "connector assembly" refers to a mated combination of a plug assembly and a receptacle assembly or a mated combination of a plug assembly, a receptacle assembly, and a high-float bi-gender bullet option.

The plug assembly 100 preferably includes two rows of contact sub-assemblies 102A and 102B. It is appreciated, however, that other configurations of the contact sub-assemblies may be used without departing from the scope of the subject matter described herein. For example, a single row, three or more rows, and staggered rows of the contact sub-assemblies may be located in the housing 210. The contact sub-assembly 102A may include a contact 104A comprising a conductive material, such as copper, hardened beryllium copper, gold- or nickel-plating, and the like for carrying electrical signals. The contact 104A may be bent at a right angle in the configuration shown, however, it is appreciated that other configurations, such as straight, may also be used without departing from the scope of the subject matter described herein. The contact 104A is preferably enclosed within an outer insulator 106A that has two parts, where a first part is configured to encase the portion of the contact 104A which is bent at the right angle, and a second part which is detachable from the first part and configured to be inserted into a receptacle as will be described in greater detail below. The contact 104A and the insulator 106A may be inserted into a ground body 108A which may be made of a conductive material or materials, such as phosphor bronze and/or selective gold- or nickel-plating, and the like.

Like the contact sub-assembly 102A, the contact sub-assembly 102B also comprises a combination of a contact 104B that is located inside of an insulator 106B, both of which are located inside of a ground body 108B. However, in contrast to the contact sub-assembly 102A, the length of the contact 104B that connects to the PCB may be shorter than the contact 104A in order to adjust for the location of the contact sub-assembly 102A on the top row of the housing 110 and the contact sub-assembly 102B on the bottom row of the housing 110. In other words, in order for all of the contact portions 102A and 102B to extend substantially equally in length into the PCB (not shown), the contacts associated with each row may be different lengths because the bottom row of the housing 110 may be located closer to the PCB than the top row.

A plurality of the contact sub-assemblies 102A or 102B may be secured together in a housing 110. The housing 110 may be made, for example, from 30% glassed-filled polybutylene terephthalate (PBT), which is a thermoplastic polymer. The housing 110 may include a plurality of holes 114 preferably in a grid-like pattern for receiving the individual contact sub-assemblies 102A or 102B. The contact sub-assemblies 102A and 102B extend through the holes 114 to define a plug interface 120 on a first end of the housing 110 and a PCB interface 122 on the other end. The housing 110 may also include one or more guide pin holes 116 for receiving stainless steel guide pins 112. The guide pins 112 may be used to securely physically connect the plug assembly 100 to other receptacle assemblies or high-float option bullet adapters, which will be described in greater detail below.

The plug housing 110 may also include various features for securing to a high float bullet adapter or receptacle. For example, one or more nubs 124 may protrude from the top portion of the housing 110 and be made of the same material as the housing 110 (e.g., plastic). Similarly, one or more nubs 126 may be located on opposite sides of the housing 110 that are different from the plug interface 120 and the PCB interface 122. The nubs 124 and 126 may be received by a corresponding nub loop located on a high float bullet adapter, which will be described in greater detail with respect to FIG. 4.

Figure 2:
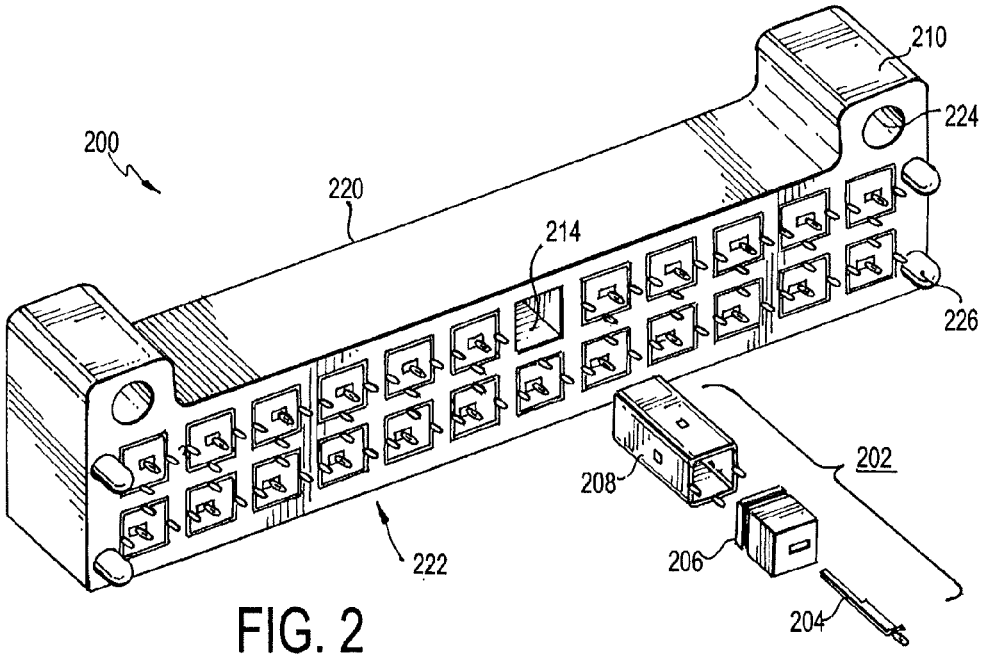
FIG. 2 is an exploded perspective view of a straight PCB receptacle assembly according to an exemplary embodiment of the present invention.

Turning to FIG. 2, a straight receptacle 200 is shown to illustrate an exemplary receptacle connector capable of interfacing with the plug 100. It is appreciated that a right angled receptacle may also be used for interfacing with the right angled plug 100, as is shown in FIG. 7A. The receptacle assembly 200 may include a plurality of contact sub-assemblies 202 for interfacing with a plug assembly, such as plug assembly 100. The receptacle contact sub-assemblies 202 are preferably provided in rows to define a receptacle interface 220 and a PCB interface 222 on the opposite side of the housing 210. Each contact sub-assembly 202 may include a contact 204, an insulator 206, and a ground body 208. The receptacle contact sub-assemblies 202 may contain similar materials and may be manufactured using similar processes as the contact sub-assemblies 102A and 102B in order to be electrically and mechanically compatible. Similar to the plug assembly 100, the receptacle contact sub-assemblies 202 are located in the holes 214 of the housing 210 for producing the receptacle assembly 200.

Guide pin holes 224 may be located in the housing 210 for receiving guide pins (not shown in FIG. 2) for securing together the receptacle housing 210 and the plug housing 110. The receptacle housing 210 may also include one or more nubs protruding from the PCB interface 222 side of the housing 210 for securing the receptacle housing 210 with the PCB (not shown). This allows for little or no axial movement between the receptacle housing 210 and the PCB which helps prevent damaging the contact pins 204.

Figure 3:
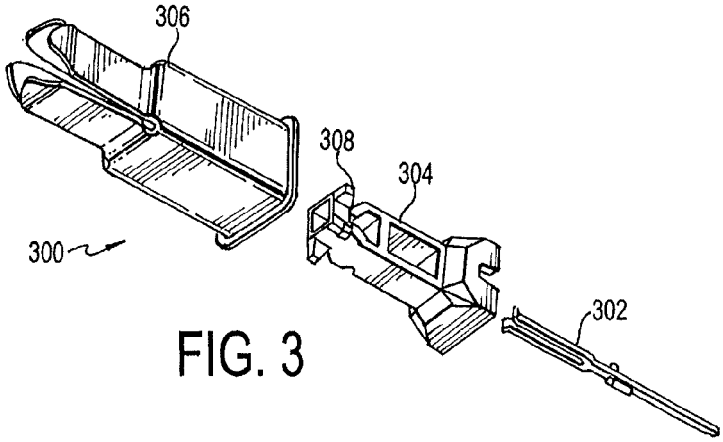
FIG. 3 is an exploded perspective view of an exemplary high float bullet sub-assembly according to an exemplary embodiment of the present invention.

FIG. 3 is an exploded view of an exemplary high-float bi-gender bullet sub-assembly according to the present invention. Referring to FIG. 3, each high-float bullet sub-assembly 300 is an adapter that includes a contact 302, an inner insulator 304, and an outer ground body 306. The contact 302 may comprise a conductive material, such as copper, hardened beryllium copper, gold- or nickel-plating, and the like for carrying electrical signals. The contact 302 is enclosed within the insulator 304 that is configured to encase the contact 302. The contact 302 and the insulator 304 may be inserted into the ground body 306. The ground body 306 may be made of a conductive material, such as phosphor bronze and/or selective gold- or nickel-plating, and the like.

Each individual bullet sub-assembly 300 is configured such that the insulator 304 preferably extends beyond the contact 302 and ground body 306 and thus protrudes from its interface at its end 308. The end 308 preferably has a lead-in geometry, such as a substantially square-based pyramid, or "dart", shape. This geometry for the insulator portion 304 is preferably narrow to allow for ganging closer together a plurality of the individual bullet sub-assemblies 300 in a more compact housing. However, it is appreciated that other lead-in geometries may be used for the insulator portion 304 without departing from the scope of the subject matter described herein.

Figure 4:
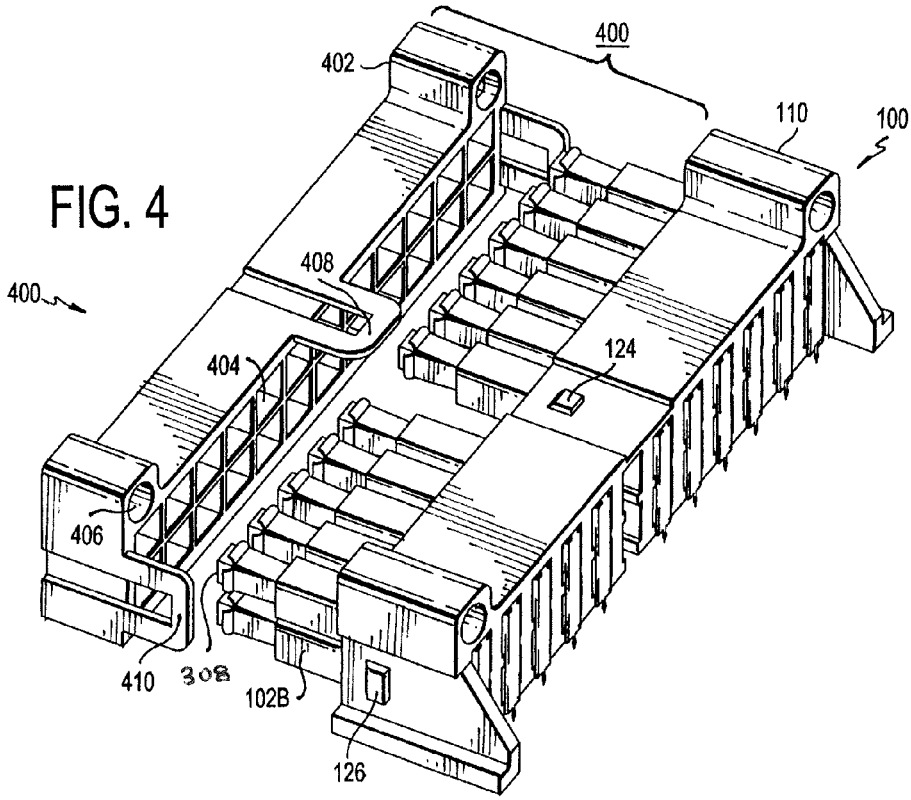
FIG. 4 is an exploded perspective view of the right angle PCB plug illustrated in FIG. 1, shown with a high float bullet option according to an embodiment of the present invention.

FIG. 4 shows an exploded view of the plug assembly 100 with a high float bullet option according to an exemplary embodiment of the present invention. Referring to FIG. 4, a plurality of the high-float bullet sub-assemblies 300 may be connected to each of the contact sub-assemblies 102A and 102B on the plug 100 and held together in an adapter housing 402 in order to create the high float bullet option 400 for the plug. Once the female end of the high float bullet option 400 has been connected to the plug 100, the male end of the high float bullet option 400 may be connected to the female end of the receptacle 200 in order to create a complete right angle-to-straight connector assembly including the high float bullet option 400. Thus, a connector assembly including the mated plug 100 and the receptacle 200 with no float therebetween may be converted to a high-float configuration by inserting the bi-gender bullet option 400 therebetween. Because the high float bullet option 400 is bi-gender, no changes are required to either the plug 100 or the receptacle 200 in order to convert from a no or low float configuration to a high float configuration.

The high float bullet adapter housing 402 may include a plurality of holes 404 preferably in a grid-like pattern for receiving the high-float bullet sub-assemblies 300. The high-float bullet sub-assemblies 300 extend through the holes 404 to connect the plug 100 to the receptacle 200. The high float bullet adapter housing 402 may also include one or guide pin more holes 406 for receiving guide pins 112. The guide pins 112 may be used to securely physically connect the plug assembly 100 to the high-float option bullet adapter 400. The guide pins 112 may be formed of stainless steel, for example.

The high float bullet adapter housing 402 may further include nub loops 408 and 410 that extend beyond the face of the holes 404 and correspond to the shape of the nubs 124 and 126 located on the plug 100 for receipt of the same. The nub loops 408 and 410 physically secure the high float bullet adapter housing 402 with the plug housing 110 in a snapping engagement. However, it is appreciated that the attachment for housings 110 and 402 other than the nubs 124-126 and the nub loops 408-410 shown in FIG. 4 may be used without departing from the subject matter described herein.

Figure 5:
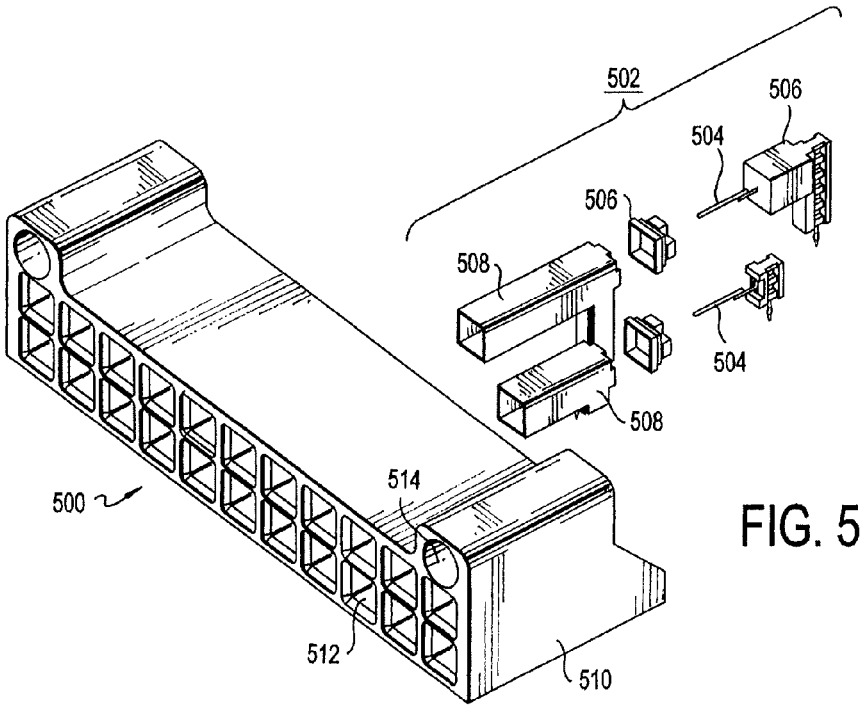
FIG. 5 is an exploded perspective view of an exemplary right angle PCB receptacle assembly according to an embodiment of the present invention.

FIG. 5 is an exploded view of an exemplary right angle receptacle assembly according to an embodiment of the subject matter described herein. The right angle receptacle 500 is an alternative to the straight receptacle 200 shown in FIG. 2. Yet similar to the straight receptacle 200, the right angle receptacle 500 includes a plurality of individual receptacle sub-assemblies 502 for mating with corresponding portions of a plug assembly, such as the plug assembly 100 shown in FIG. 1. The individual receptacle sub-assemblies 502 may each include a contact 504, an insulator 506, and a ground body 508 as described earlier. It is appreciated that the receptacle sub-assemblies 502 may come in a variety of possible shapes/configurations including, but not limited to, the configuration shown in FIG. 5.

Also similar to the straight receptacle configuration 200, the individual receptacle sub-assemblies 502 may be secured together in a housing 510. For example, the housing 510 may include a plurality of holes 512 preferably in a grid-like pattern for receiving the individual receptacle sub-assemblies 502 and the high-float bullet sub-assemblies 300, and/or the plug interface 120 of the plug 100. The receptacle sub-assemblies 502 extend through the holes 512 to connect the plug 100 to the receptacle 200. The housing 510 may also include one or guide pin more holes 514 for receiving the guide pins 112. The guide pins 112 may be used to securely physically connect the receptacle assembly 500 to the high-float option bullet adapter 400. The housing 510 may be formed of plastic and may include additional holes for receiving one or more guide pins for maintaining alignment between connectors. In contrast to the straight receptacle 200, the housing 510 of the right angle receptacle 500 maybe larger than the housing 210 in order to accommodate the increased length associated with the receptacle sub-assemblies 502.

Figure 6A:
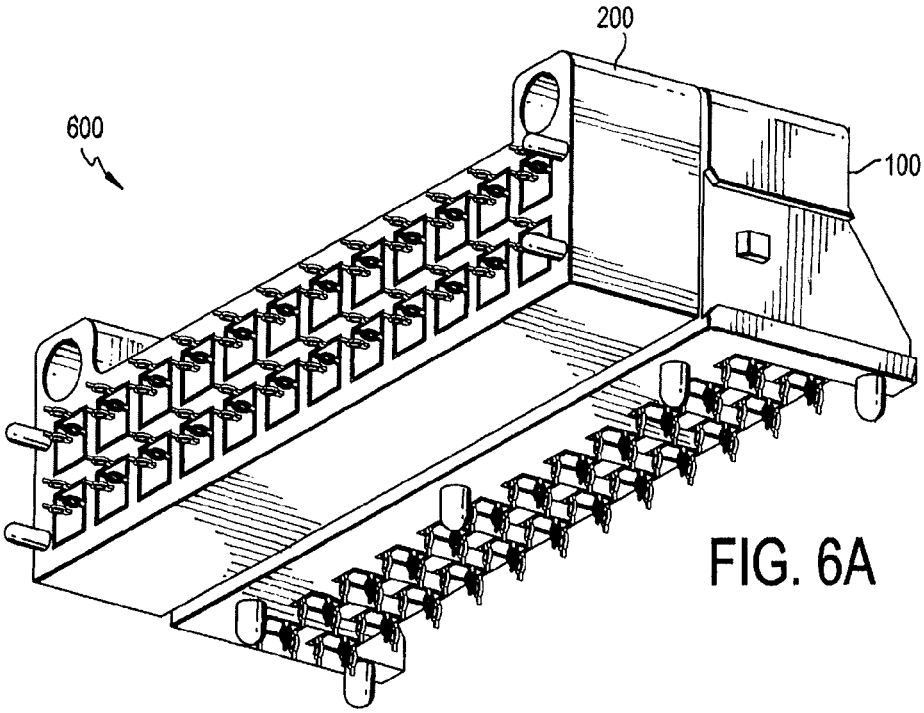
FIG. 6A is a perspective view of the right angle plug illustrated in FIG. 1 mated to the straight receptacle illustrated in FIG. 2, shown as a non-bulleted mated solution according to an embodiment of the present invention.

FIG. 6A is a perspective view of a non-bulleted connector assembly 600 of the plug assembly 100 connected to the receptacle assembly 200 according to an exemplary embodiment of the present invention. Because no bullet is located between the plug assembly 100 and the receptacle assembly 200, no or a low amount of radial float exists between the plug assembly 100 and the receptacle assembly 200. Thus, the non-bulleted connector assembly configuration 600 is shown to illustrate an exemplary no or low-float configuration that is suitable for being modified through the addition of the high float bullet option 400 therebetween, which is shown and described in FIGS. 7A and 7B below.

Figure 6B:
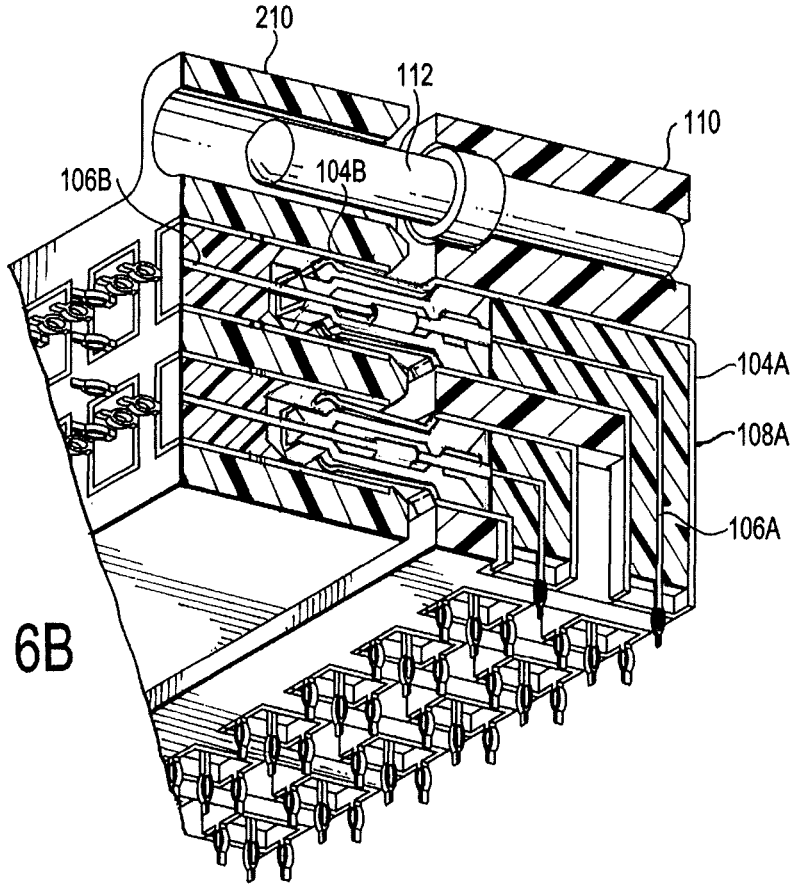
FIG. 6B is an enlarged cut-away view of the right angle plug-to-straight receptacle non-bulleted mated solution shown in FIG. 6A.

FIG. 6B is a zoomed-in cut-away view of the non-bulleted connector assembly 600 shown in FIG. 6A. Referring to FIG. 6B, the right angle plug assembly 100 includes the conductor 106A surrounded by the insulator 104A and the ground body 108A. Similarly, the receptacle assembly 200 includes the conductor 106B surrounded by the insulator 104B and the ground body 108B. The housing 110 and the housing 210 are further secured together by one ore more guide pins 112.

In the connector assembly configuration shown in FIG. 6B, it is appreciated that a first PCB (not shown) may be connected to the portions of connector pins 106A extending beyond the housing 110. Likewise, a second PCB (not shown) may be connected to the portions of connector pins 106B extending beyond the housing 210. Because the pins 106A are bent at a ninety degree angle and the pins 106B are straight, the right angle-to-straight connector assembly configuration 600 allow for connecting the first and the second PCBs at a right angle to one another, which may be desirable in certain applications. It will be appreciated that the connector assembly according to the present invention, can be any combination of a right-angle or straight plug assembly mated with a right-angle or straight receptacle assembly.

FIG. 7A is a perspective view of an exemplary right angle plug-to-straight receptacle including a bi-gender high-float bullet adapter option according to an exemplary embodiment of the present invention. Referring to FIG. 7A, the bulleted connector assembly 700 comprises the right angle plug assembly 100, the right angle receptacle 500, and the high float bullet 400 connected therebetween. The high float bullet option 400 provides for a higher amount of radial float between the right angle plug 100 and the right angle receptacle 500 while maintaining the same axial float of the non-bulleted solution.

Figure 7B:
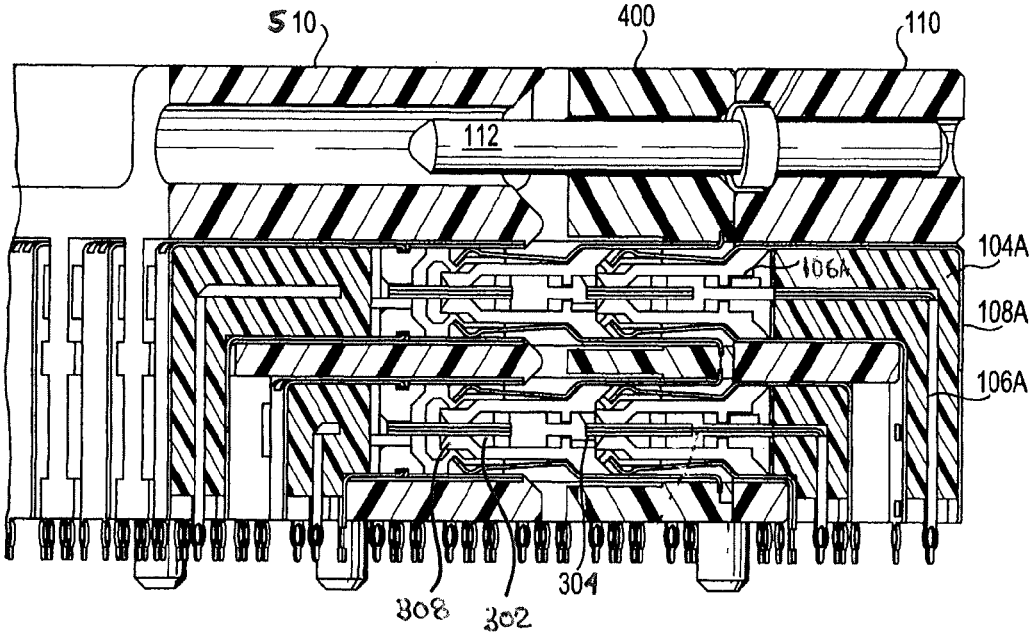
FIG. 7B is an enlarged cut-away side view of the exemplary right angle plug-to-right angle receptacle bulleted mated solution shown in FIG. 7A.
Figure 7A:
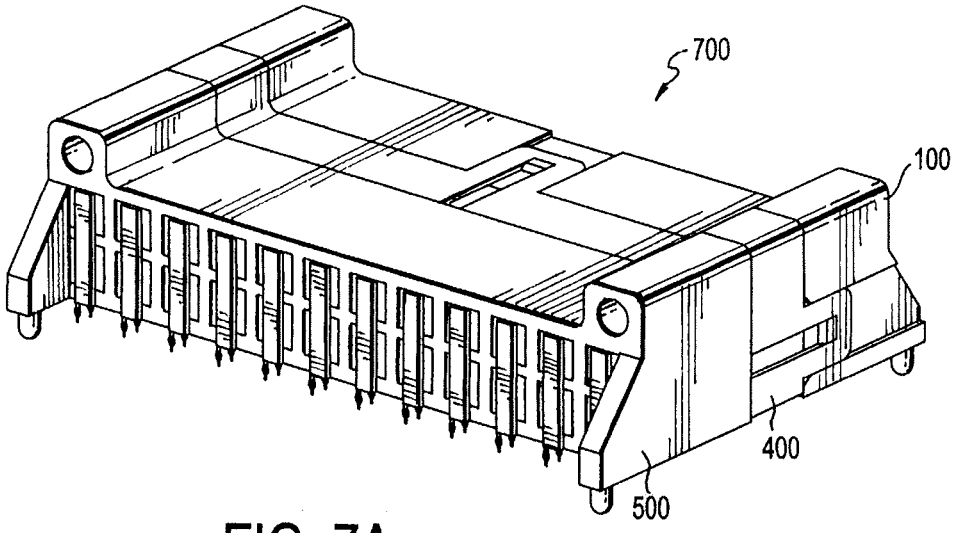
FIG. 7A is a perspective view of the right angle plug assembly illustrated in FIG. 1 mated to the right angle receptacle assembly illustrated in FIG. 5, shown as a bulleted mated solution according to an embodiment of the present invention.

FIG. 7B is an enlarged cut-away side view of the exemplary right angle plug-to-right angle receptacle bulleted solution shown in FIG. 7A. Referring to FIG. 7B, the components of the right angle plug assembly 100 include the conductor 106A surrounded by the insulator 104A and the ground body 108A. Similarly, the right angle receptacle assembly 500 includes a plurality of receptacle sub-assemblies 502 each comprising the conductor 504 surrounded by the insulator 506 and the ground body 508. The plug housing 110 is further secured to the receptacle housing 510 by the guide pin 112, which runs through the guide pin hole 402 of the bullet adapter housing 400. It will be appreciated that the connector assembly according to the present invention, can be any combination of a right-angle or straight plug assembly mated with a right-angle or straight receptacle assembly.

As described above, the high float bullet adapter 400 includes a plurality of high-float bullet sub-assemblies 300 for interfacing between the male portion of the plug 100 and the female portion of the receptacle 500, where each high-float bullet sub-assembly 300 comprises the conductor 302, the insulator 304, and the ground body 306. Because the high float bullet adapter 400 can be designed to be compatible with the configurations of the plug 100 and the receptacle 500, the high float bullet adapter 400 may be inserted or removed from between the plug assembly 100 and the receptacle assembly 500 in order to easily and quickly convert between high float and low float configurations.

The shape of the high-float bullet sub-assemblies 300 allows for increased axial and radial movement (i.e. float) between the plug and receptacle assemblies and a more compact footprint while maintaining a secure electrical connection. Specifically, the shape of the high-float bullet sub-assemblies 300 includes the insulator 304 of each individual bullet sub-assembly 300 preferably extending beyond the contact 302 and thus protruding from its interface with a substantially square-based pyramid, or "dart", shaped lead-in geometry. This geometry for the insulator portion 304 is smaller than conventional lead-in geometries and allows for ganging closer together a plurality of the individual bullet sub-assemblies 300 in a more compact housing while increasing the degree of float. Each of these advantages over the prior art may be useful in a variety of applications, but particularly in RF connector applications such as wireless telecommunications applications, including WiFi, PCS, radio, computer networks, test instruments, and antenna devices.

Figure 8A:
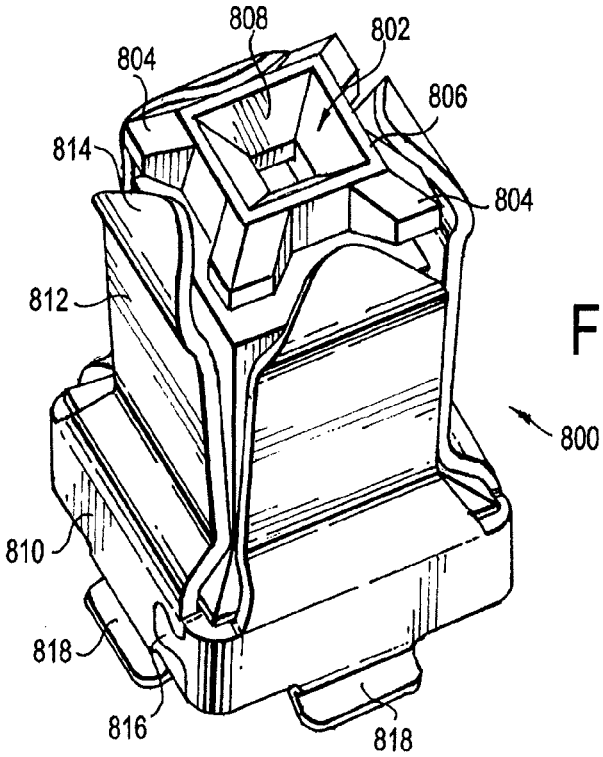
FIGS. 8A and 8B are perspective views of an alternative high float bullet sub-assembly according to an exemplary embodiment of the present invention.
Figure 8B:
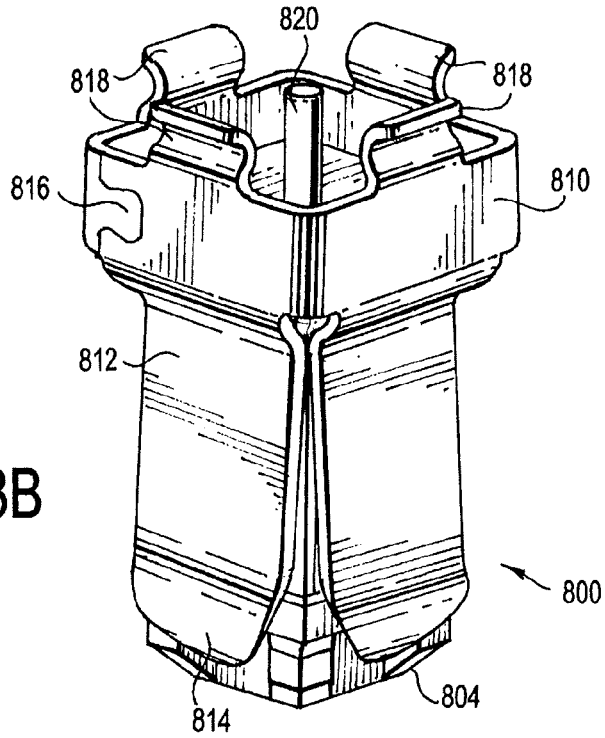

FIGS. 8A and 8B are perspective views of an alternative high float bullet sub-assembly according to an alternative exemplary embodiment of the present invention for providing float between plug and jack assemblies. Similar to the bullet sub-assembly 300, the high float bullet sub-assembly 800 generally includes an inner insulator 802, a contact 820, and an outer ground body 810. The insulator 802 may be made of plastic and preferably has a lead-in geometry at its end 806 that may be a narrowing, substantially pyramid-like shape that extends beyond an outer ground body 810. Each corner 804 of the insulator portion 802 may include a center ridge that extends downward and away from a substantially square rim of the high float bullet sub-assembly 800. Further, the ridge of each corner 804 is flanked by two parallel edges which define the sides of the corner 804 and also extend downward away from the inner rim at the same angle. It is appreciated that other configurations for the insulator portion 802 and/or corners 804, including more or fewer than four corners as well as rounded tip-shapes, may be used without departing from the scope of the subject matter described herein. Inside the rim 806 is an inner substantially square sloping portion 808 which slopes inward toward a center conductor which aids in gathering.

The outer ground body 810, typically made of metal, which surrounds the insulator portion 802 may include four sidewalls 812 corresponding to each side of the insulator portion 802. The tips 814 of the sidewalls 812 may be curved inward toward the center of the bullet 800 and may be located in between the corners 804 of the dielectric portion 802. The outer ground body 810 may be composed as one-piece or multiple pieces secured together with a dovetail joint 816, for example, or any other suitable means. The base 822 of the ground body 810 may further include tail portions 818 on each side in the embodiment shown. Tail portions 818 are preferably curved outwardly, as seen in FIG. 8B.

FIGS. 9A and 9B are perspective views of a plug interface assembly 900 into which the bullet sub-assembly 800 snaps to provide float. The plug interface assembly 900 includes an inner insulator 902 surrounded by an outer ground body 904. The inner insulator 902 and the ground body 904 are shorter and/or smaller than the bullet ground body 810 of the bullet sub-assembly 800. Additionally, the base of the ground body 904 may include a plurality of tail portions 906 for connecting directly to a PCB. The bullet sub-assembly 900 also includes and a contact tab 908 that connects to a PCB.

As seen in FIG. 9B, the plug interface assembly 900 may include an outer housing 910 to help center the bullet on the PCB and provide additional retention according to an exemplary embodiment of the present invention. The housing 910 is preferably plastic and surrounds the ground body 904. The housing 910 includes a base portion 911 from which four loops 912 extend which corresponding to each side of the ground body 904. The loops 912 may be used for additional securing the bullet sub-assembly 800 to the plug interface assembly 900 during maximum radial offset, where the tail portions 818 of the bullet sub-assembly 800 are captivated by the loops 912 preventing the bullet sub-assembly 800 from pulling off of the plug interface assembly 900. However, it is appreciated that other configurations of the loops 912 and the housing 910 may be used without departing from the scope of the subject matter described herein.

Figure 10:
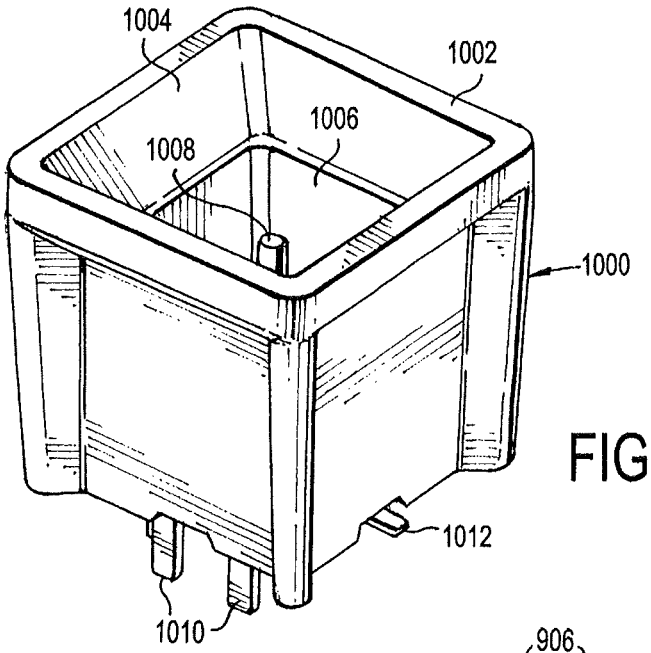
FIG. 10 is a perspective view of a mating component of a high float bullet sub-assembly according to an exemplary embodiment of the present invention; sub-assembly according to an exemplary embodiment of the present invention.

FIG. 10 is a perspective view of a mating jack assembly 1000 for the high float bullet sub-assembly 800 and the plug interface assembly 900 according to an exemplary embodiment of the present invention. The mating jack assembly 1000 includes a housing with a substantially square-shaped outer rim 1002 and an inward and downward sloping, inner surface 1004 for providing a gathering surface to a receiving area 1006. The mating component 1000 includes an outer surface that is connected to the outer rim 1002 and an inner surface that is connected to the inside portion of the inner sloping portion 1004 for defining the inner receiving area 1006. Inside the receiving area 1006 is an inner conductor 1008 which mates to the inner conductor 820 of the bullet sub-assembly 800.

Figure 11:
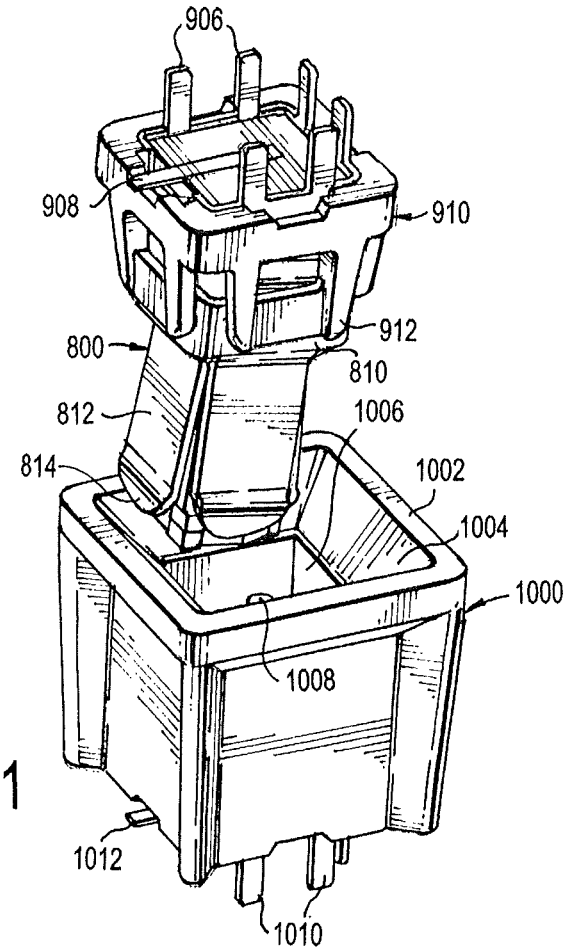
FIG. 11 is an exploded perspective view of the bullet sub-assembly of FIGS. 8A and 8B being mating with the mating component of FIG. 10, showing the process of gathering according to an exemplary embodiment of the present invention.
Figure 12:
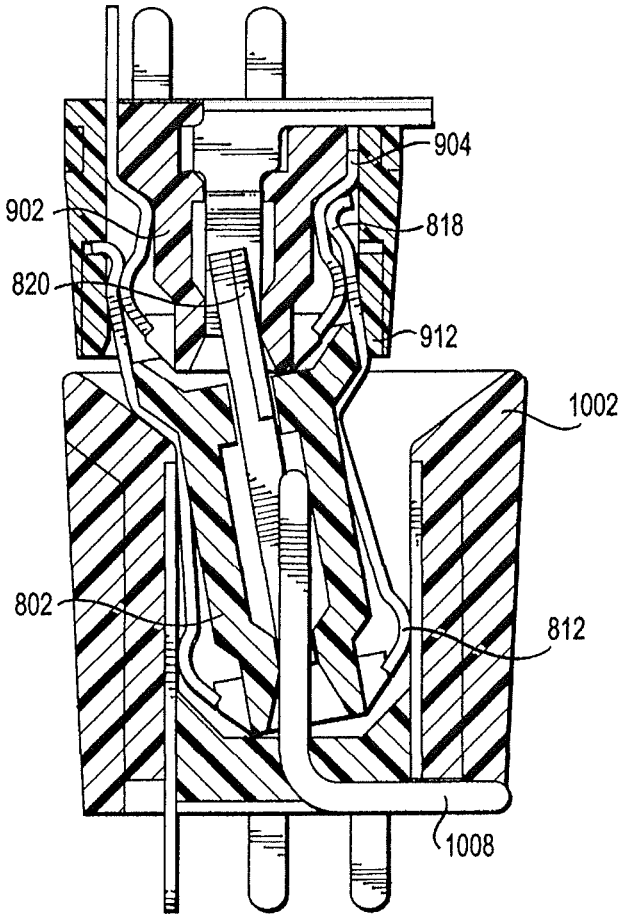
FIG. 12 is cross-sectional view of the components mated, according to an exemplary embodiment of the present invention.

As seen in FIGS. 11 and 12 the high float bullet sub-assembly 800 shown in FIG. 8C on the plug assembly 900 is mated or gathered with the mating jack assembly 1000 where the bullet sub-assembly 800 provides float between the two components at maximum radial offset. The bullet sub-assembly 800 may be supported by outer housing 910. The tail portions 818 of the bullet sub-assembly 800 provide a dual functionality for retention of the bullet 800 onto plug assembly 900. The inward curvature of the bullet tail portions 818 snap into the respective inward curvature 920 of the mating tines on the plug assembly 900. The outward curvature of the bullet tail portions 818 snap into the housing loops 912, preventing the bullet sub-assembly 800 from pulling off of the inward snap when the bullet sub-assembly is at an increased angle with respect to the axis of plug assembly 900. The bullet body 810 is supported and centered by the plug assembly hoops 912. The end of the bullet sub-assembly 800 can be inserted into and gather in the receiving area 1006 of the mating component 1000.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A high float bullet adapter, comprising:

an inner contact;

an insulator supporting said inner contact, said insulator having corners; and an outer ground body holding said inner contact and said insulator, said outer ground body having at least one tip, wherein an end of said insulator extends beyond said inner contact and said outer ground body, said end of said insulator having a lead-in geometry, and said at least one tip of said outer ground body is located between said corners of said insulator.

2. A high float bullet adapter according to claim 1, wherein said end of said insulator includes a square geometry.

3. A high float bullet adapter according to claim 1, wherein said end of said insulator includes a pyramid shape.

4. A high float bullet adapter according to claim 1, wherein said lead-in geometry of said end of said insulator includes a rim with an inner sloping portion.

5. A high float bullet adapter according to claim 1, wherein said outer ground body includes a plurality of sidewalls, at least one of said sidewalls has a tip that is curved inwardly toward said end of said insulator.

6. A high float bullet adapter according to claim 1, wherein said outer ground body includes a plurality of tail portions.

7. A high float bullet adapter according to claim 6, wherein at least one of said tail portions is curved outwardly.

8. A high float bullet adapter according to claim 6, wherein at least one of said tail portions is configured to couple directly to a printed circuit board.

9. A high float bullet adapter according to claim 1, further comprising an outer housing supporting at least a base of said outer ground body.

10. A high float bullet adapter according to claim 9, wherein said outer ground body is conductive; and said outer housing is non-conductive.

11. A high float bullet adapter according to claim 1, further comprising a mating component including a receiving area configured to receive said outer ground body, said receiving area having an inner contact.

12. A high float bullet adapter according to claim 11, wherein said receiving area having an inner sloping portion.

13. A high float bullet adapter according to claim 11, wherein said mating component includes a pin for coupling directly to a printed circuit board.

14. A high float connector assembly, comprising:

a first connector having at least a first contact;

a second connector configured to mate to said first connector, said second connector having at least a second contact;

a high float bullet adapter disposed between said first and second connectors, said high float bullet adapter including a housing having at least one hole; and at least one high float bullet subassembly received in said hole of said housing of said high float bullet adapter, said at least one high float bullet subassembly having an inner contact, an insulator supporting said inner contact, and an outer ground body holding said inner contact and said insulator, said insulator having an end with a lead-in geometry, said inner contact engaging said first and second contacts of said first and second connectors, respectfully, wherein said at least one high float bullet subassembly provides float between said first and second connectors.

15. A high float connector assembly according to claim 14, wherein said first connector is one of a right angle plug or a straight plug; and said second connector is one of a right angle receptacle or a straight receptacle.

16. A high float connector assembly according to claim 14, wherein said first connector includes a plurality of first contacts;

said second connector includes a plurality of second contacts;

said housing of said high float bullet adapter includes a plurality of holes; and a plurality of high float bullet subassemblies received in said plurality of holes, respectfully, each of said high float bullet subassemblies having an inner contact, an insulator supporting said inner contact, and an outer ground body holding said inner contact and said insulator, said insulator having an end with a lead-in geometry, each of said inner contacts engaging respective said first and second contacts of said first and second connectors, respectfully.

17. A high float connector assembly according to claim 16, wherein said plurality of holes are arranged in one or more columns and rows and said one or more columns and rows are staggered.

18. A high float connector assembly according to claim 14, wherein each of said first and second connectors are adapted to engage a printed circuit board.

19. A high float connector assembly according to claim 14, wherein said end of said insulator includes a square or pyramid geometry.

20. A high float connector assembly according to claim 14, wherein said lead-in geometry of said end of said insulator includes a rim with an inner sloping portion.

21. A high float connector assembly according to claim 14, wherein said outer ground body includes a plurality of sidewalls, at least one of said sidewalls has a tip that is curved inwardly toward said end of said insulator; and said outer ground body includes a plurality of tail portions, and at least one of said tail portions is curved outwardly.

22. A high float connector assembly according to claim 14, wherein said housing includes one or more guide pins holes for receiving one or more guide pins for physically securing the housing to said first and second connectors.

23. A high float connector assembly according to claim 14, wherein said housing includes one or more nub loops that extend beyond the face of said housing for physically securing said housing to said first and second connectors in a snapping engagement.

24. A high float connector assembly according to claim 14, wherein said housing is formed of a non-conductive material.

25. A high float bullet adapter, comprising:

an inner contact;

an insulator supporting said inner contact; and an outer ground body holding said inner contact and said insulator, wherein an end of said insulator extends beyond said inner contact and said outer ground body, said end of said insulator having a lead-in geometry, said end of said insulator includes a square geometry or a pyramid shape.

* * * * *